US006870153B2

(12) United States Patent
Goodall et al.

(10) Patent No.: US 6,870,153 B2
(45) Date of Patent: Mar. 22, 2005

(54) ANALYTICAL INSTRUMENT FOR MEASUREMENT OF ISOTOPES AT LOW CONCENTRATION AND METHODS FOR USING THE SAME

(75) Inventors: Philip Stephen Goodall, Cumbria (GB); Barry Leonard Sharp, Leicestershire (GB)

(73) Assignee: British Nuclear Fuels Plc (GB)

( * ) Notice: Subject to any disclaimer, the term of this patent is extended or adjusted under 35 U.S.C. 154(b) by 0 days.

(21) Appl. No.: 10/716,963

(22) Filed: Nov. 19, 2003

(65) Prior Publication Data

US 2004/0099802 A1 May 27, 2004

Related U.S. Application Data

(63) Continuation of application No. 09/914,330, filed as application No. PCT/GB00/00577 on Feb. 18, 2000, now abandoned.

(30) Foreign Application Priority Data

Feb. 25, 1999 (GB) ..... 9904289

(51) Int. Cl.[7] ..... H01J 49/00
(52) U.S. Cl. ..... 250/281; 250/282; 250/288
(58) Field of Search ..... 250/281, 282, 250/288

(56) References Cited

U.S. PATENT DOCUMENTS 4,686,366 A * 8/1987 Stuke ..... 250/287
4,734,579 A 3/1988 Lucatorto et al.
5,068,534 A * 11/1991 Bradshaw et al. ..... 250/288
5,313,067 A 5/1994 Houk et al.
5,471,059 A 11/1995 Freedman et al.
5,640,010 A 6/1997 Twerenbold
5,679,950 A 10/1997 Baba et al.
5,872,629 A 2/1999 Colvard
6,028,308 A 2/2000 Hager
6,184,982 B1 2/2001 Karanassios

FOREIGN PATENT DOCUMENTS

EP 0611169 A1 2/1994 ..... H01J/49/02
GB 2176649 A 12/1986 ..... H01J/49/40
GB 2219432 A 12/1989 ..... H01J/49/40
GB 2267994 A 12/1993 ..... H01J/49/02
GB 2273200 A 6/1994 ..... H01J/49/40
GB 2288273 A 10/1995 ..... H01J/49/26

OTHER PUBLICATIONS

Kellner et al., Analytical Chemistry, © 1998, pp. 827–828.

UK Patent Office Search Report for priority application, dated Mar. 29, 1999.

* cited by examiner

*Primary Examiner*—John R. Lee
*Assistant Examiner*—Paul M. Gurzo
(74) *Attorney, Agent, or Firm*—Myers Bigel Sibley & Sajovec

(57) ABSTRACT

An inductively coupled plasma source mass spectrometer is equipped with a multidimensional detector system wherein ions transmitted by the mass spectrometer are detected.

72 Claims, 2 Drawing Sheets

Figure 1:
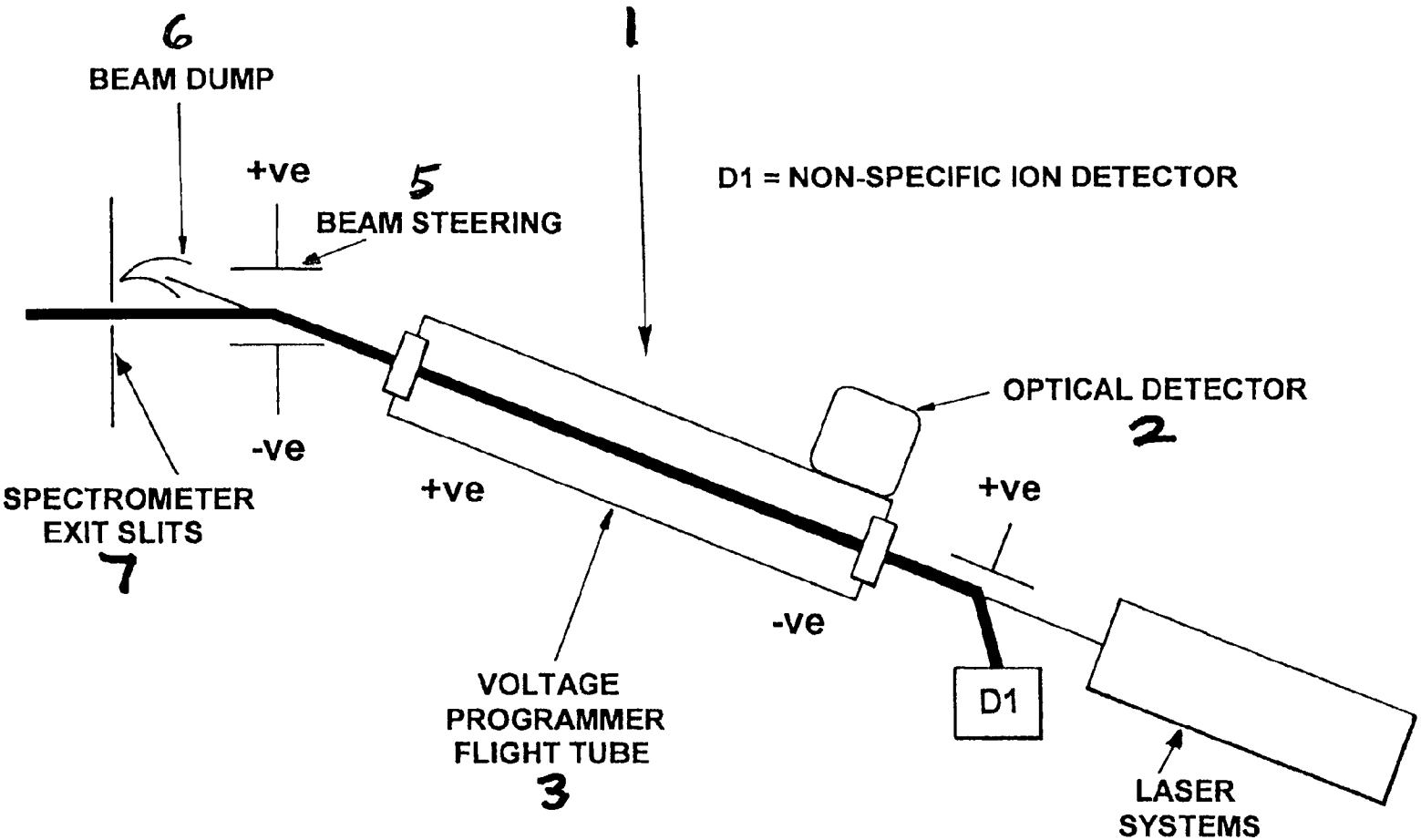

D1-3 = CONVENTIONAL ION DETECTION
D4 = OPTICAL DETECTOR
N.B. A THREE SLIT ASSEMBLY HAS BEEN SHOWN FOR EXAMPLE ONLY

ANALYTICAL INSTRUMENT FOR MEASUREMENT OF ISOTOPES AT LOW CONCENTRATION AND METHODS FOR USING THE SAME

RELATED APPLICATIONS

This application claims priority and is a continuation of parent application Ser. No. 09/914,330 filed Feb. 12, 2002 now abandoned, which claims the benefit of PCT Application Serial No. PCT/GB00/00577 filed 18 Feb. 2000; the application was published in English under PCT Article 21(2). The international application claims priority from GB Application Serial No. 9904289.7 filed 25 Feb. 1999. The contents of these applications are hereby incorporated by reference as if recited in full herein.

FIELD OF THE INVENTION

This invention relates to a novel analytical instrument, and to novel methods of measuring, inter alia, low concentrations of stable and radioisotopes and/or low abundance isotopes.

BACKGROUND OF THE INVENTION

The determination of radionuclides at environmental levels using classical radiometric counting is well established and likely to remain the method of choice for short half-life species. However, innovations in analytical instrumentation in the last ten years have the potential to replace radiometric counting for a wide range of longer half-life species.

Elemental and isotopic analysis has advanced significantly with the introduction of plasma source mass spectrometry. A variety of plasmas have been used as ionization. sources, e.g., glow discharges, microwave induced plasmas, but the inductively coupled plasma (ICP) is the most widely accepted, and de facto, the preferred ion source for atomic mass spectrometry. The inductively coupled plasma is compatible with solid, liquid or gaseous sample introduction and is a robust and efficient ionization source for atomic mass spectrometry.

For some potential applications of plasma mass source spectrometry, e.g., environmental and biomedical monitoring of radioisotopes, current techniques may not possess the required detection limits or selectivity. Classical radiometric techniques may provide the required detection limits, but do so at the expense of protracted count times and extensive sample preparation and clean-up. For example, within a plutonium bioassay program, current radiometric methods offer detection limits of 500 $\mu$Bq per litre, but require 1–2 days of sample preparation and radiometric count times of, e.g., four days with $\alpha$-spectrometry and up to 28 days for $\alpha$-track counting. there is a requirement to develop plasma source mass spectrometry to provide enhanced selectivity and improved detection limits without sacrificing the inherent flexibility, repidity and robustness of the technique.

SUMMARY OF THE INVENTION

The instrument of the invention is designed to measure isotopes at extremely low concentrations and isotopes of very low abundance. An example of this would be the ultra low level determination of the radionuclides. The increasing interest in the behaviour of radionuclides in the biosphere requires that new methods be developed that have detection limits equivalent to, or better than, that of the existing techniques, but combine this with superior speed and a reduced cost of analysis. Improvements in speed are essential to enable wider screening, plant and event management and to monitor illicit uses of nuclear materials. The recent OSPAR agreement has committed the UK to real reductions in levels of liquid effluent discharges. For many radionuclides, conventional radiochemical analysis will limit the ability to demonstrate that such reductions have been achieved.

To achieve the aim of improved detection limits in plasma source mass spectrometry, the factors that limit the selectivity and sensitivity of inductively coupled plasma mass spectrometry (ICP-MS) were considered. The instrumental detection limits available from ICP-MS are, in most cases, limited by the background count and not the magnitude of the analytical signal derived from the ions of interest. The background is derived broadly from three distinct sources:

1. A non-specific instrumental background.
2. Interferences from atomic or molecular ions of the same nominal mass to charge ratio, consequent upon insufficient mass spectral resolution. Examples of these "isobaric" interferences include atomic ions such as; $^{241}Am^+$, $^{241}Pu^+$; $^{90}Sr^+$, $^{90}Zr^+$; $^{55}Fe^+$, $^{55}Mn^+$; $^{40}Ar$; $^{204}Pb^+$, $^{204}Hg^+$ or molecular ions such as $^{238}U^1H^+$, $^{239}Pu^+$; $^{40}Ar^{16}O^+$, $^{56}Fe^+$, $^{40}Ar^{35}Cl^+$, $^{75}As^+$
3. Isotopes of different nominal masses but present at high relative abundances, consequent upon insufficient abundance sensitivity. For example, $^{88}Sr$, $^{89}Sr$, $^{90}Sr$; $^{55}Fe^+$, $^{56}Fe^+$.

These observations are the key to the development of instrumentation with the superior detection limits required for determination of radionuclides at background environmental and biomedical concentrations by ICP-MS techniques.

A comparison of alternative techniques to plasma source mass spectrometry suggests that resonance ionisation mass spectrometry (RIMS) offers similar or better absolute detection limits than achieved with current generation ICP-MS instruments, e.g. about $4\times10^6$ atoms for $^{259}$ Pu. The singular advantage of RIMS over, for example, ICP-MS, is the greater isotopic selectivity derived from the laser induced ionisation process. However, the prior chemical separation, though less demanding that not required by radio-chemical methods, is nevertheless time consuming and requires specific recovery of the element, deposition onto a Ta foil and overplating with TL Accelerator mass spectrometry (AMS) offers absolute detection power of the order of $10^6$ atoms. Selectivity is achieved through the use of high energy dissociation of molecular ions and avoidance of isobars through negative ion discrimination. Improved detection limits are obtained by high energy counting to discriminate against detector background. High abundance sensitivity is achieved by acceleration to high potentials thus minimizing the relative ion energy spread. However, AMS involves large, complex and costly instrumentation. Sample preparation is complex and time consuming, requiring preparation of the element in a pure form. For these reasons, AMS is restricted to highly specialized roles and cannot at this time be considered as a laboratory scale or general purpose instrument.

Thus, we have now developed analytical instrument and an analytical approach that overcomes or mitigates the problems with conventionally known instruments and techniques. As a technology demonstration, this new device is based upon an ICP-MS instrument, but is equally applicable to other forms of plasma mass spectrometry. Indeed, the range of applications includes all forms of atomic mass spectrometry and molecular mass spectrometry. This instrumentation also provides a flexible platform for spectroscopic studies of atoms and molecules to determine fundamental parameters.

Thus according to the invention, we provide an instrument comprising an Inductively Coupled Plasma Source Mass Spectrometer equipped with a multi-dimensional detector system wherein ions transmitted by the mass spectrometer are detected with high selectivity.

The instrument is provided preferably with detectors which are based upon specific detection of transmitted ions, e.g. via optical spectroscopy. The device is in principle an ICP-MS instrument operating in a multi-dimensional detection mode and including the following:

A conventional non-specific ion detection device.

A device based upon optical spectroscopy to provide highly selective and specific detection of ions transmitted by the mass spectrometer.

The detector device based upon optical spectroscopy provides:

A high resolution detection system, which in conjunction with conventional mass spectrometry, is capable of resolving ions of interest from interfering molecular ions of similar nominal mass to charge ratio.

A high resolution spectroscopy system, which in conjunction with conventional mass spectrometry, is capable of resolving ions of interest from atomic ions of similar nominal mass to charge ratio.

A high resolution spectroscopy system which in conjunction with conventional mass spectrometry, provides very high abundance sensitivity.

Operation of the two detection systems as a single integrated coincidence detector that provides:

Background count rates that are orders of magnitude lower than those obtained if the individual detection systems were used as isolated, individual detectors.

The descriptive term for this approach is Inductively Coupled Plasma Mass Spectrometry Coincidence Laser Spectroscopy (ICP-MS-CLS).

Thus, according to a preferred feature of the invention, we provide an ICP-MS-CLS instrument. We especially provide an ICP-MS-CLS instrument with a conventional non-specific ion detection device and a device based on optical spectroscopy as hereinbefore defined.

The instrument of the invention supplements the universal ion counting detector with one that has a high degree of species selectivity. The use of a detector based on resonance scattering from the ions to be detected, e.g., laser induced fluorescence (LIF), provides vastly improved selectivity thereby removing the problem of isobaric interference derived from either atomic or molecular ions, Additionally, by operating the optical detector in time correlation with a second detector, background count rates can be reduced by several orders of magnitude.

The instrumentation takes advantage of improved detector technology to achieve very high spatial and temporal resolution in the optical spectroscopy. This allows coincidence detection from single photons. This capability is important in that it allows the detection of ions in which there is a high probability of trapping in a metastable state. Ions in metastable states are transparent to the exciting laser and thus the overall photon multiplicity from these ions is low.

To allow for efficient interaction between the laser and ion beam, the ion beam must be defined accurately in space and be focussed to approximately the beam diameter of the laser. An imaging spectrometer provides an ideal solution and a sector mass spectrometer is one such device. A commercial, double focussing, sector ICP-MS provides the basic platform for development of ICP-MS-CLS.

A key feature of this instrument is the manipulation of the ion energies. To couple efficiently the energy from the laser into the ion to be detected, the optical bandwidths have to be matched. For example, an ion beam of energy of 5000±2.5 eV, has a Doppler spread of about 100 MHz for an ion of mass=240. This is in excess of the natural line width which is off the order of 15 MHz. The ion energies were manipulated by two devices. The first involves the introduction of a collision/reaction cell to act as an ion bridge between the sampler/skimmer plasma interface and the mass spectrometer. This thermalises the ions and reduces their energy spread to less than 1 eV. Additionally, it enables selective gas phase chemistry to dissociate interfering molecular ions. The second method involves acceleration of the ions to compress the optical bandwidth of the ions to be detected. For example, an ion beam of mass 240 but with a 40 000±5 eV energy range has a corresponding Doppler spread of about 37 MHz. In practice, by using a collision/reaction cell, lower standing voltages, e.g., 10 kV, can be employed. Assuming an ion energy spread of, e.g., 1 eV, at 10 kV, the Doppler spread is about 15 MHz which approximates natural line widths.

Programmed acceleration of the ions within the optical detector is important and ensures that the ions to be detected come into resonance with the exciting laser within the detection volume of the optical detector. This prevents optical trapping of the ions prior to their arrival in the detection volume of the optical detector.

The abundance sensitivity of the spectrometer can be improved by three methods:

Where the analyte exhibits an isotope shift, the ion of interest can be brought into resonance selectively.

Selective excitation of one hyperfine branch of an ion of interest can also be used to increase the selectivity of the mass spectrometer.

Many ions do not exhibit an isotope shift that can be resolved optically, but acceleration of the ions induces an isotope shift by Doppler shifting the resonant frequency of the low abundant ion away from the interfering major isotope.

Where optical trapping of the ions of interest becomes significant, this may be addressed via the use of two-colour excitation schemes in which the metastable state is in resonance with one of the laser frequencies. To provide maximum flexibility and elemental coverage, a two-colour CW laser system was employed. A twin laser system allows a variety of excitation schemes to be used, combining single color, two color, multiphoton excitation and combinations thereof.

A multi-slit assembly was included in the instrumentation for simultaneous detection of major isotopes, to be monitored via conventional detectors, to allow isotope ratio measurements. This will also provide reference beams so that the performance of the sample introduction system and ICP ion source can be monitored continuously and optimized.

BEIEF DESCRIPTION OF THE FIGURES

Figure 2:
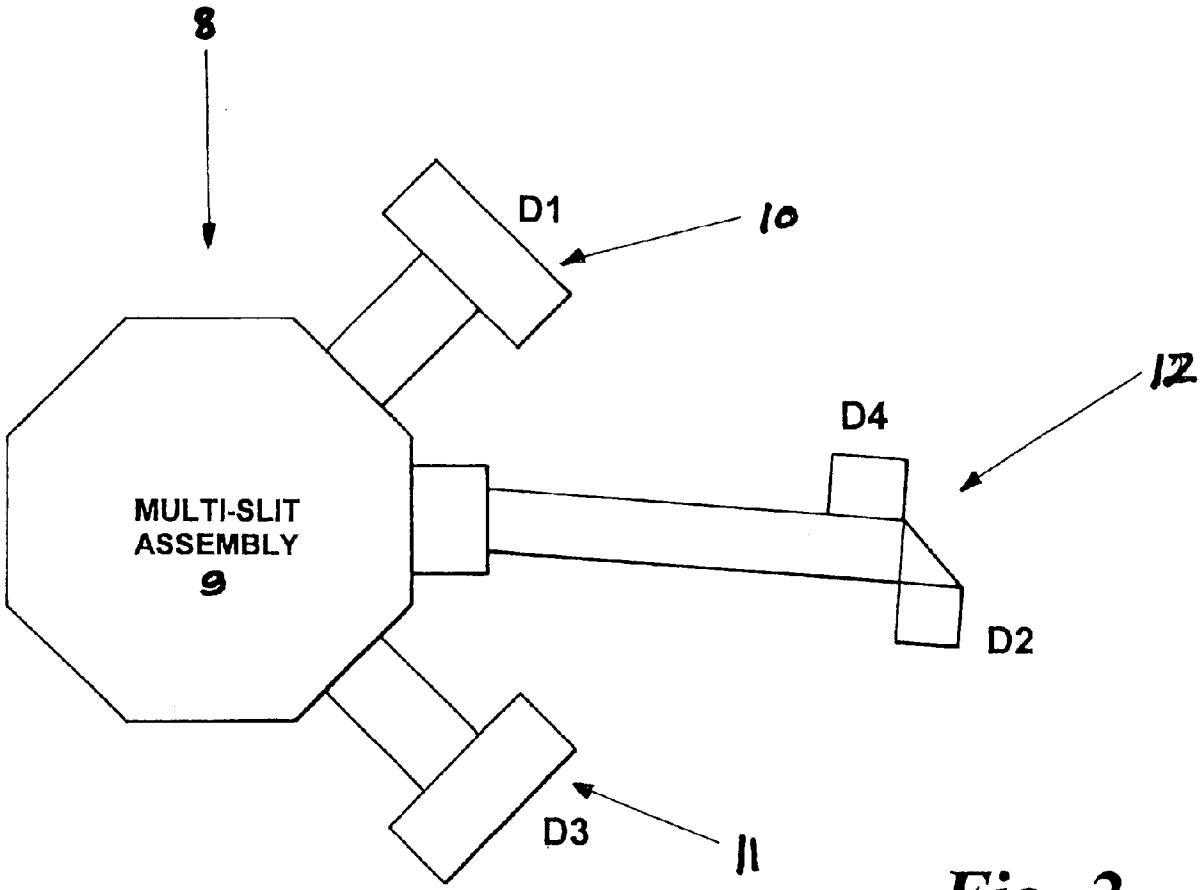

The invention will now be illustrated, but in no way limited, with reference to the following examples and the accompanying drawings, in which, FIG. 1 is a schematic representation of a Coincidence Laser Spectrometer, and FIG. 2 is a schematic representation of a multi-detector head including a detector based upon a Coincidence Laser Spectrometer.

DETAILED DESCRIPTION OF EMBODIMENTS OF THE INVENTION

Referring to FIG. 1, a coincidence laser spectrometer (1) comprises an optical detector (2) coupled to a voltage programmer flight tube (3), which tube is provided with a laser system (4) and a non-specific ion detector (D1). Charged beam steering optic (5) are situated adjacent to an exit port from the flight tube. The apparatus may be provided with beam dumping means (6) adjacent to spectrometer exit slits (7).

Referring to FIG. 2, a spectrometer assembly (8) comprises a multi-slit assembly (9) coupled to conventional ion-detectors (10 and 11) and a coincidence laser spectrometer (12) (as defined by FIG. 1).

EXAMPLE 1

Verification of Instrument Performance—Determination of Low Abundance Isotopes, e.g. $^{10}$Be The operating characteristics of the system were established via an established CLS transition, e.g., the Be (II) line at 313 nm which is readily accessible to a CW tunable laser. Beryllium is an important element in its own right and its high mass isotope ($^{10}$Be) is an important geochronometer. It is produced by nuclear spallation of oxygen by cosmic rays and reaches an equilibrium concentration in surface quartz of about $2\times10^{7}$ atoms per $g^{-1}$. An isobaric interference with $^{10}$B exists, but this can be resolved in the optical detector. A reasonable measurement of $^{10}$Be was made by processing of a 5 g solution after removal of the major matrix elements. Other cosmogenic isotopes that might be amenable to detection include those of K, Cs, Ca, Mn, Ni, Pd, Al and the lanthenides depending on identifying suitable spectroscopic transitions.

EXAMPLE 2

Determination of Pu in Urine for Bioassay Purposes

An aliquot of urine was spiked with a Pu tracer, processed to remove the bulk of the matrix and yielded a final sample volume of 1 $cm^3$. This sample was analyzed by ICP-MS-CLS using a low flow sample introduction system. The isotope ratios of isotope was monitored on a conventional detector whilst the isotopes of interest were determined using CLS detection. Isobaric interferences from, for example, $^{238}U^{+}$, $^{238}U^{1}H^{+}$, $^{204}Pb^{35}Cl^{+}$, $^{241}$Am, were resolved optically in the CLS detector. A complete chemical separation of Pu from the matrix was not required and a simple, rapid, group separation of the actimides yielded a sample suitable for analysis by ICP-MS-CLS.

EXAMPLE 3

Determination of Fundamental Nuclear Parameters

Optical isotope shifts and fine structure can be used to probe nuclei for the purpose of deriving fundamental nuclear data. The ICP-MS-CLS instrumentation allows the precise measurement of optical isotope shifts using the voltage programming facilities to bring isotopes into resonance selectively with the tuneable laser operating in frequency locked mode.

What is claimed is:

1. An apparatus for the measurement of isotopes at extremely low concentration and isotopes of very low abundance, the apparatus comprising an Inductively Coupled Plasma Source Mass Spectrometer equipped with a multi-dimensional detector system wherein ions transmitted by the mass spectrometer are detected with high selectivity; wherein the multi-dimensional detector system comprises:

a multi-slit assembly, wherein the mass spectrometer is coupled to the multi-slit assembly and wherein the mass spectrometer is a coincidence laser spectrometer comprising:

an optical detector coupled to the multi-slit assembly for specific detection of transmitted ions;

a voltage programmer flight tube coupled to the optical detector, the voltage programmer flight tube including a non-specific ion detector configured for the non-specific counting of transmitted ions, the flight tube further including an exit port at a first end thereof and a laser system at a second end thereof; and a charged beam steering optics assembly positioned proximate the exit port of the flight tube.

2. An apparatus according to claim 1 wherein the multi-dimensional detector system comprises a plurality of sub-systems which provide a unitary response.

3. An apparatus according to claim 2 wherein the multi-dimensional detector system comprises two sub-systems.

4. An apparatus according to claim 3 wherein the two sub-systems of the multidimensional detector system are correlated temporally with high resolution.

5. An apparatus according to claim 4 that provides co-incidence detection of transmitted ions.

6. An apparatus according to claim 2 wherein the sub-systems comprise the optical detector for specific detection of transmitted ions and the non-specific ion detector.

7. An apparatus according to claim 6 wherein the optical detector is based on optical spectrometry.

8. An apparatus according to claim 7 wherein the specific detection of the transmitted ions is via resonance scattering processes.

9. An apparatus according to claim 8 wherein the specific detection of the transmitted ions is via laser induced fluorescence.

10. An apparatus according to claim 8 provided with means for collecting and detecting resonantly scattered photons efficiently.

11. An apparatus according to claim 8 provided with means for the detection of the resonantly scattered photons with high temporal and spatial resolution.

12. An apparatus according to claim 11 wherein the detection of resonantly scattered photons is via an imaging photomultiplier tube.

13. An apparatus according to claim 7 wherein the ion beam is accelerated to induce an optical isotope shift by Doppler shifting.

14. An apparatus according to claim 1 provided with means for manipulating the mean ion energy thereby reducing the relative spread of the ion beams energies.

15. An apparatus according to claim 14 wherein the relative spread of ion beam energies may be manipulated to compress the optical bandwidth of the transmitted ions.

16. An apparatus according to claim 14 provided with means for accelerating or decelerating the transmitted ion beam to manipulate the average ion beam energy and consequently the relative spread of ion beam energies.

17. An apparatus according to claim 1 wherein a front-end collision/reaction cell is used to reduce the spread of the ion beam energies and compress the optical bandwidth of the transmitted ions.

18. An apparatus according to claim 1 provided with means for manipulating the ion beam energies to bring the transmitted ion beam into resonance within the detection volume of the optical detector.

19. An apparatus according to claim 18 provided with means for accelerating or decelerating the ion beam.

20. An apparatus according to claim 1 wherein the detector system is mounted upon an axial exit slit.

21. An apparatus according to claim 1 wherein additional nonspecific ion detectors are mounted upon the multiple exit slit assembly.

22. An apparatus according to claim 21 wherein additional nonspecific ion detectors are mounted upon off-axis exit slits.

23. A method for detecting and quantifying low concentrations of stable and/or radioisotopes and/or low abundance isotopes which comprises analyzing a sample in an apparatus according to claim 1.

24. A method according to claim 23 wherein the species being detected is a radionuclide.

25. A method according to claim 23 wherein selectivity is enhanced by specific optical detection of transmitted ions.

26. A method according to claim 23 wherein selectivity is enhanced by specific isotopic selection via optical isotope shifts.

27. A method according to claim 23 wherein selectivity is enhanced by inducing an optical isotope shift by acceleration of the transmitted ions with subsequent Doppler shifting.

28. A method according to claim 23 wherein selectivity is enhanced by optical probing of hyperfine splitting.

29. A method according to claim 23 wherein nonspecific background is reduced by co-incidence detection of transmitted ions with subsequent improved detection limit.

30. The apparatus of claim 1, further comprising a second non-specific ion detector mounted on the multi-slit assembly.

31. The apparatus of claim 1, wherein the optical detector is configured to detect transmitted ions by resonance scattering.

32. The apparatus of claim 1, wherein the optical detector is configured to detect transmitted ions by laser induced fluorescence.

33. An apparatus as claimed in claim 1 for the ultra low level determination of radionuclides.

34. An apparatus as claimed in claim 1 wherein the optical detector comprises an optical spectrometer.

35. An apparatus as claimed in claim 34 wherein said optical spectrometer is adapted to provide highly selective and specific detection of ions transmitted by the mass spectrometer.

36. An apparatus as claimed in claim 35 wherein said optical spectrometer provides a high resolution detection system, which in conjunction with conventional mass spectrometry, is capable of resolving ions of interest from interfering molecular ions of similar nominal mass to charge ratio.

37. An apparatus as claimed in claim 35 wherein said optical spectrometer provides a high resolution spectroscopy system, which in conjunction with conventional mass spectrometry, is capable of resolving ions of interest from atomic ions of similar nominal mass to charge ratio.

38. An apparatus as claimed in claim 35 wherein said optical spectrometer provides a high resolution spectroscopy system, which in conjunction with conventional mass spectrometry, provides very high abundance sensitivity.

39. An apparatus as claimed in claim 34 wherein said optical spectrometer operates in time correlation with a second detector.

40. An apparatus as claimed in claim 1 which comprises an Inductively Coupled Plasma Mass Spectrometry Coincidence Laser Spectrometer.

41. An apparatus as claimed in claim 1, said apparatus comprising a laser induced fluorescence spectrometer.

42. An apparatus as claimed in claim 1 which comprises an imaging spectrometer.

43. An apparatus as claimed in claim 42 wherein said imaging spectrometer comprises a sector mass spectrometer.

44. An apparatus as claimed in claim 43 wherein said sector mass spectrometer comprises a double focusing sector Inductively Coupled Plasma Mass Spectrometer.

45. An apparatus as claimed in claim 44 which comprises a collision/reaction cell to act as an ion bridge between a sampler/skimmer plasma interface and the mass spectrometer.

46. An apparatus as claimed in claim 44 which comprises means for effecting acceleration of ions to compress the optical bandwidth of the ions to be detected.

47. An apparatus as claimed in claim 1, adapted such that the abundance sensitivity of the spectrometer is improved.

48. An apparatus as claimed in claim 47 wherein an ion of interest is brought into resonance selectively.

49. An apparatus as claimed in claim 47 wherein the selectivity of the mass spectrometer is increased by selective excitation of one hyperfine branch of an ion of interest.

50. An apparatus as claimed in claim 47 wherein acceleration of the ions induces an isotope shift by Doppler shifting the resonant frequency of the low abundant ion away from the interfering major isotope.

51. An apparatus as claimed in claim 1 which comprises two-colour excitation schemes wherein a metastable state is in resonance with a laser frequency.

52. A method for the measurement of isotopes at extremely low concentrations and isotopes of very low abundance which comprises analysing a sample in an apparatus as claimed in claim 1.

53. A method as claimed in claim 52 for the ultra low level determination of radionuclides.

54. A method as claimed in claim 52, wherein said optical detector of said apparatus comprises an optical spectrometer.

55. A method as claimed in claim 54 wherein said optical spectrometer is adapted to provide highly selective and specific detection of ions transmitted by the mass spectrometer.

56. A method as claimed in claim 55 wherein said optical spectrometer provides a high resolution detection system, which in conjunction with conventional mass spectrometry, is capable of resolving ions of interest from interfering molecular ions of similar nominal mass to charge ratio.

57. A method as claimed in claim 55 wherein said optical spectrometer provides a high resolution spectroscopy system, which in conjunction with conventional mass spectrometry, is capable of resolving ions of interest from atomic ions of similar nominal mass to charge ratio.

58. A method as claimed in claim 55 wherein said optical spectrometer provides a high resolution spectroscopy system, which in conjunction with conventional mass spectrometry, provides very high abundance sensitivity.

59. A method as claimed in claim 54 wherein said optical spectrometer operates in time correlation with a second detector.

60. A method as claimed in claim 52 which comprises analysing a sample in an Inductively Coupled Plasma Mass Spectrometry Coincidence Laser Spectrometer.

61. A method as claimed in claim 52, wherein said apparatus comprises a laser induced fluorescence spectrometer.

62. A method as claimed in claim 52, wherein said apparatus comprises an imaging spectrometer.

63. A method as claimed in claim 62 wherein said imaging spectrometer comprises a sector mass spectrometer.

64. A method as claimed in claim 63 wherein said sector mass spectrometer comprises a double focusing sector Inductively Coupled Plasma Mass Spectrometer.

65. A method as claimed in claim 64 wherein said apparatus comprises a collision/reaction cell to act as an ion bridge between a sampler/skimmer plasma interface and the mass spectrometer.

66. A method as claimed in claim 64 wherein said apparatus comprises means for effecting acceleration of ions to compress the optical bandwidth of the ions to be detected.

67. A method as claimed in claim 52, wherein said apparatus is adapted such that the abundance sensitivity of the spectrometer is improved.

68. A method as claimed in claim 67 wherein an ion of interest is brought into resonance selectively.

69. A method as claimed in claim 67 wherein the selectivity of the mass spectrometer is increased by selective excitation of one hyperfine branch of an ion of interest.

70. A method as claimed in claim 67 wherein acceleration of the ions induces an isotope shift by Doppler shifting the resonant frequency of the low abundant ion away from the interfering major isotope.

71. A method as claimed in claim 52 wherein said apparatus comprises two-colour excitation schemes wherein a metastable state is in resonance with a laser frequency.

72. A apparatus for the measurement of isotopes at extremely low concentration and isotopes of very low relative abundance, said apparatus comprising an Inductively Coupled Plasma Mass Spectrometer equipped with a multi-dimensional detector system wherein ions transmitted by the mass spectrometer are detected with high selectivity, wherein the multi-dimensional detector system comprises a coincidence laser spectrometer coupled to an axial exit slit of the mass spectrometer, said coincidence laser spectrometer comprising:

a charged beam steering optic to couple the exit slit of the mass spectrometer to an entrance slit of the coincidence laser spectrometer;

a voltage programmer flight tube to accelerate or retard the ion beam and consequently interact that ion beam with a co-axial laser system in an optical detector system; and a charged beam steering optic coupled to an exit port of the optical detector to direct the ion beam onto a non-specific ion detector configured for non-specific counting of the transmitted ions.

* * * * *